United States Patent [19]

Lathrop et al.

[11] 4,377,320

[45] Mar. 22, 1983

[54] COAXIAL CONNECTOR

[75] Inventors: John C. Lathrop, Harrisburg; Ronald C. Laudig, Mechanicsburg, both of Pa.

[73] Assignee: AMP Incorporated, Harrisburg, Pa.

[21] Appl. No.: 210,694

[22] Filed: Nov. 26, 1980

[51] Int. Cl.[3] ..... H01R 13/12

[52] U.S. Cl. ..... 339/177 R

[58] Field of Search ..... 339/177 R, 177 E, 258 R, 339/258 P, 258 RR, 91 R, 259 R, 143 R

[56] References Cited

U.S. PATENT DOCUMENTS 3,406,376 10/1968 Varrin ..... 339/258
3,745,514 7/1973 Brishka ..... 339/91 R
3,871,735 3/1975 Herrmann, Jr. ..... 339/177 R
4,017,139 4/1977 Nelson ..... 339/177 R X

*Primary Examiner*—Joseph H. McGlynn
*Attorney, Agent, or Firm*—Adrian J. LaRue; Gerald K. Kita

[57] ABSTRACT

A coaxial connector is disclosed for terminating a coaxial transmission line. The connector includes a tubular spring element, comprising a cylindrical body having a plurality of reversely formed leaf spring fingers annularly spaced, and projecting forwardly therefrom. The spring fingers are intended for positionment within a tubular plug shell, and are engaged and compressed upon insertion of a jack body therebetween for retaining and electrically contacting the jack body.

16 Claims, 6 Drawing Figures

COAXIAL CONNECTOR

BACKGROUND OF THE INVENTION

1. The Field of the Invention

The present invention relates to coaxial connector plugs, generally, and specifically to SMB-style coaxial plugs and jacks.

2. The Prior Art

Coaxial connectors available presently in the industry, comprise a variety of different styles. One commercially popular style is the so called SMB plug and jack, which is defined by military specifications and functions to terminate coaxial transmission lines.

Presently available SMB style coaxial plugs generally comprises a female member having a slotted tubular structure forming jaws, a split ring having a diameter which receives the tubular member therein for providing spring resiliency, and an outer protective hood for protecting the jaw member. Such a structure is illustrated in U.S. Pat. No. 3,745,514. Pursuant thereto, a male member is inserted into the slotted tubular part, causing the jaws to resiliently expand, with the degree of expansion controlled by the split ring encompassing the jaws.

While the above identified connector is generally accepted by the industry several shortcomings prevent this configuration from totally satisfying the needs of the industry. First, the presently available connector is composed entirely of screw machine formed components, which adds considerably to the cost of the unit and thereby limits its acceptance in the market. Specifically, the slotted tubular part is screw machine from brass and the outer split ring, which wraps around the slotted part, is formed of copper to provide resiliency. A separate hood is also taught by the prior art for surrounding the aforesaid components for the purpose of protection. This type of construction and assembly is relatively expensive, comprises a relatively large number of components, and results in a somewhat larger dimensioned plug than the industry would prefer.

SUMMARY OF THE PRESENT INVENTION

The present invention relates to a SMB-style coaxial connector, comprising a unitary tubular shell body having a tubular spring element seated therein which is configured as follows. The spring element includes a large cylindrical forward end, having a plurality of forwardly projecting leaf spring fingers annularly spaced about the forward periphery of the cylindrical portion. Each of the spring fingers is provided with a reversely bent U-shaped profile, which is compressably engaged by the contact shell of a mating jack upon coupling. The compression of the spring fingers accomplishes the two-fold objectives of establishing electrical contact between the plug and jack, as well as effectuating positive retention of the jack shell inside of the plug shell. The conductive component parts of the present invention are comprised entirely of either stamped and formed or drawn bodies, which substantially reduces the cost of manufacturing. Moreover, the present configuration includes fewer component parts, which are readily assembled, requiring no soldered connections, and results in a smaller plug profile. Thus, the prescribed military specifications are satisfied, but a lower cost is incurred in manufacturing the presently configured coaxial connector over the connectors of the prior art. The tubular shell body is further provided with means for protecting the spring fingers from misengagement and lateral manipulation of the jack.

Accordingly it is an object of the present invention to provide a coaxial connector for terminating coaxial transmission cable which comprises relatively few component parts.

A further object of the present invention is to provide a coaxial connector which is fully crimpable to coaxial cable.

Yet a further object of the present invention is to provide a coaxial connector having a relatively small diameter profile.

Still further, it is an object of the present invention to provide a coaxial connector which comprises stamped and formed contacts, and drawn body members.

A still further object of the present invention is to provide a coaxial connector which provides for convenient assembly, and which comprises improved spring retention means and means for protecting said spring retention means.

Still a further object of the present invention is to provide a coaxial connector which is economically and readily produced, and readily assembled.

These and other objects, which will become apparent to one skilled in the art are achieved by a preferred embodiment which is described in detail below and which is illustrated in the accompanying drawings.

BRIEF DESCRIPTION OF THE ACCOMPANYING DRAWINGS

DETAILED DESCRIPTION OF THE PREFERRED EMBODIMENT

Figure 1:
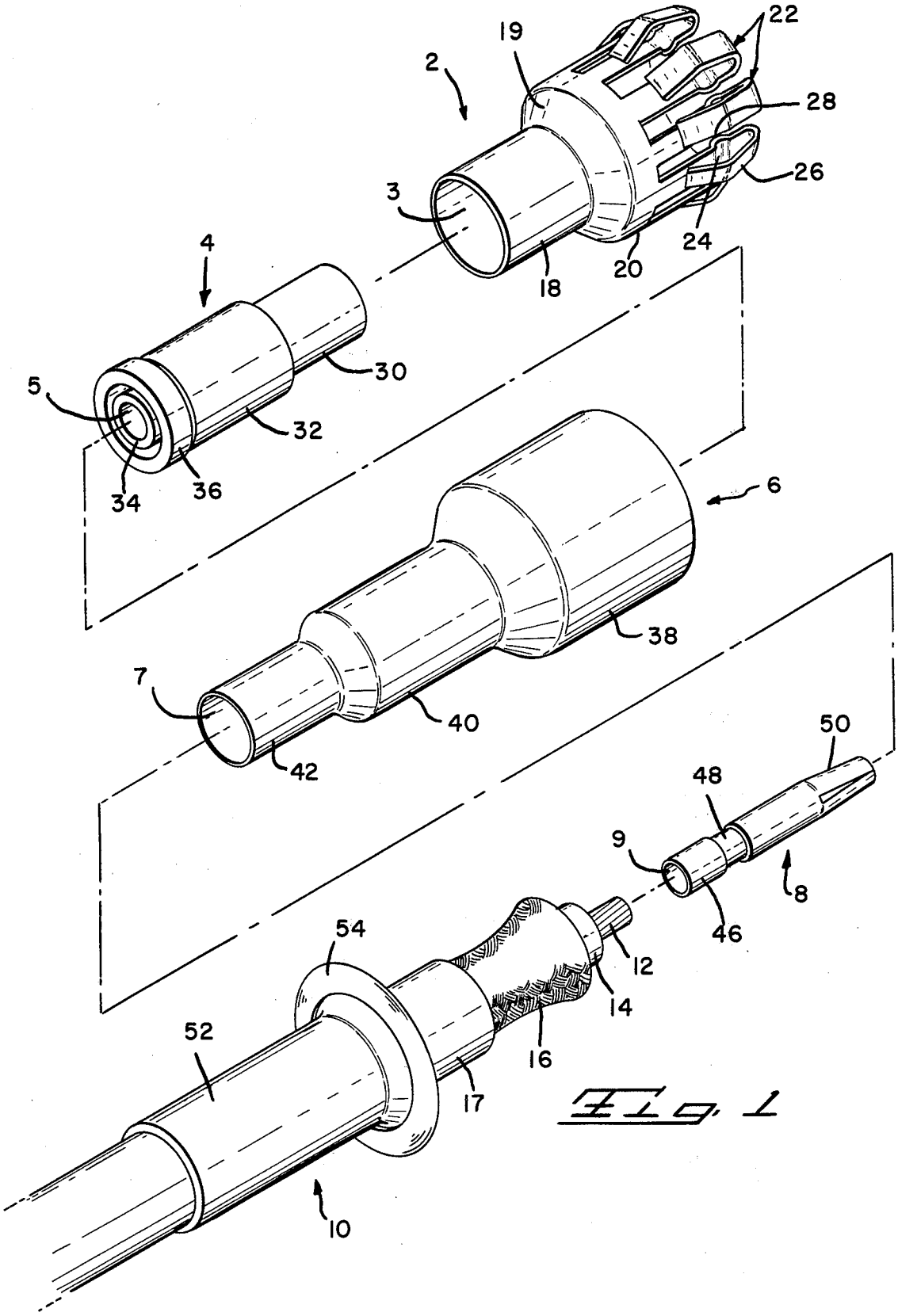
FIG. 1 is an exploded view of the subject coaxial connector plug configured pursuant to the present invention.

Referring first to FIG. 1 the subject invention comprises a coaxial connector plug including the following components: a tubular spring element 2 having an axial bore 3 extending therethrough; a dielectric body 4 having an axial bore 5 extending therethrough; a shell body 6 likewise having an axial bore 7 extending therethrough; a center contact having an axial bore 9 extending therethrough; and a crimping ferrule 10. The subject plug is intended for termination of a coaxial transmission cable comprising a center conductor 12, surrounded by a dielectric layer 14, which in turn is surrounded by an outer conductive shield 16 and an outer insulative sheath 17. The tubular spring element 2 is structured having a rearward cylindrical portion 18 of generally smaller diameter dimension, and a larger dimensioned forward cylindrical portion 20 integrally joined to portion 18 by a shoulder 19. A plurality of integral spring fingers 22 are annularly spaced about the forward peripheral profile of the cylindrical portion 20, and project forwardly therefrom. Each spring finger 22 constitutes an inner leaf 24 integrally joined to the cylindrical portion 20, and a reversely formed outer leaf 26. The inner leaf 24 is further provided with a transversely extending detent ridge 28 formed as illustrated. The above configured spring member 2 is formed in a progressive dye in a manner common in the industry.

Figure 4:
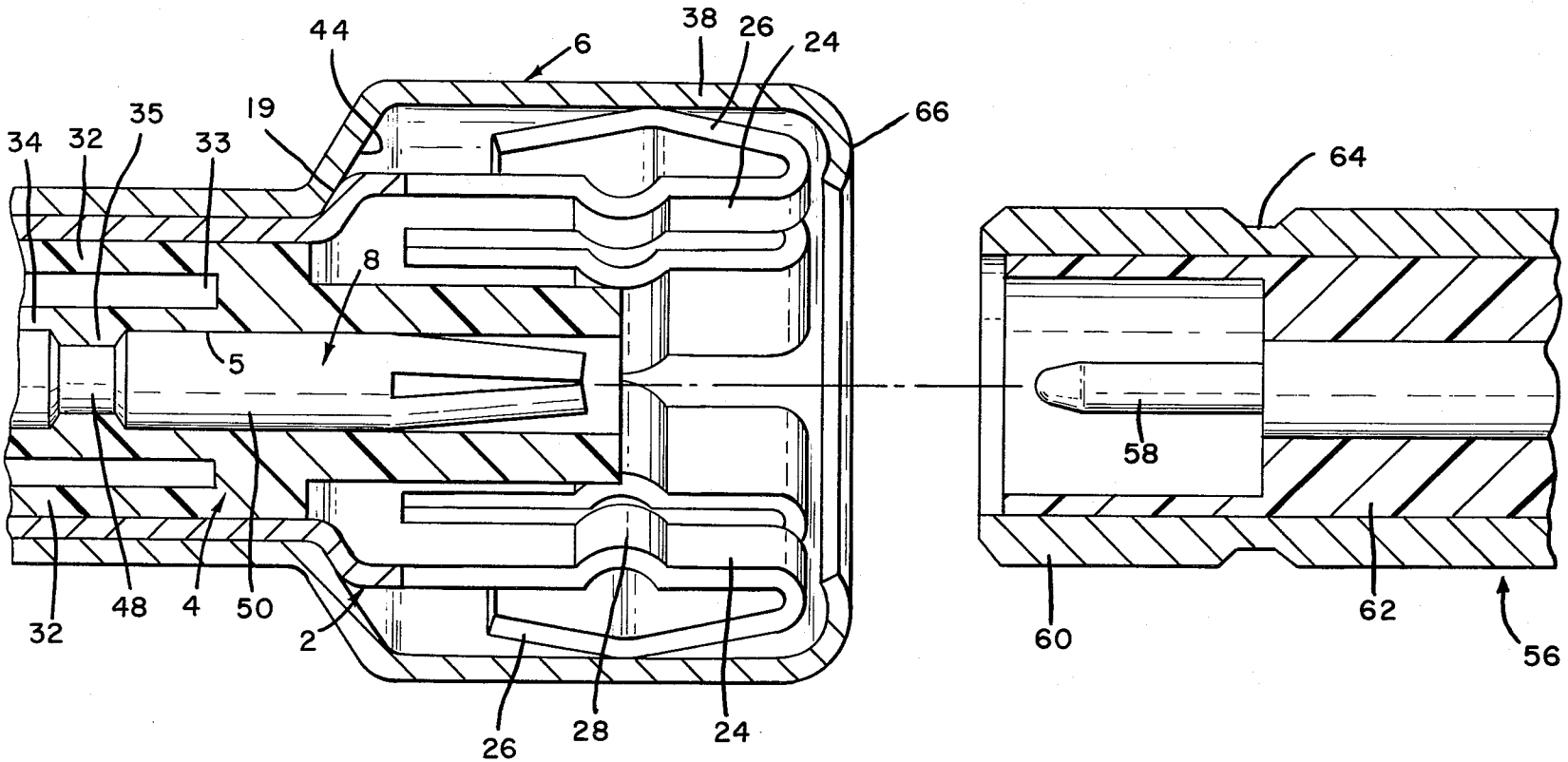
FIG. 4 is a longitudinal section view through the forward end of the subject coaxial connector plug illustrated in FIG. 3, together with the forward end of the mating jack half.

The dielectric body 4 has a generally elongate profile and unitarily includes a forward cylindrical sleeve 30 and rearwardly disposed, coaxial outer cylindrical sleeve 32 and inner cylindrical sleeve 34. The coaxial sleeves, 32, 34 are radially spaced apart by a gap 33 as best seen in FIG. 4. The inner cylindrical sleeve 34 also provides an annularly extending detent 35 which projects into the axial bore 5. Also, from FIG. 1, the dielectric body 4 includes an annular flange 36 which is located at a rearward end of the body.

The outer shell 6 is of a unitary construction, and constitutes a forward relatively large diametered hood 38, an intermediate cylindrical portion 40, and a rearward smaller diametered portion 42. The shell 6 provides an internal shoulder 44 as best viewed from FIG. 4.

Returning to FIG. 1, the center receptacle contact 8 is configured having a rearward crimping barrel 46, an intermediate annular retention recess 48, and a female receptacle portion 50 at the forward end thereof. Likewise, the crimping ferrule 10 is provided with a rearward crimp barrel 52 at the rearward end thereof. An outwardly directed annular flange 54 is provided at the forward end of the crimping ferrule 10.

Proceeding to FIG. 4, the above described coaxial connector plug intermates with a coaxial jack 56, comprising a center pin 58, an outer conductive shell 60, which is electrically isolated from the center pin 58 by a dielectric body 62. The outer conductive shell 60 is provided with an annularly extending retention recess 64 spaced a prescribed distance from the forward end of the jack.

Figures 2, 3:
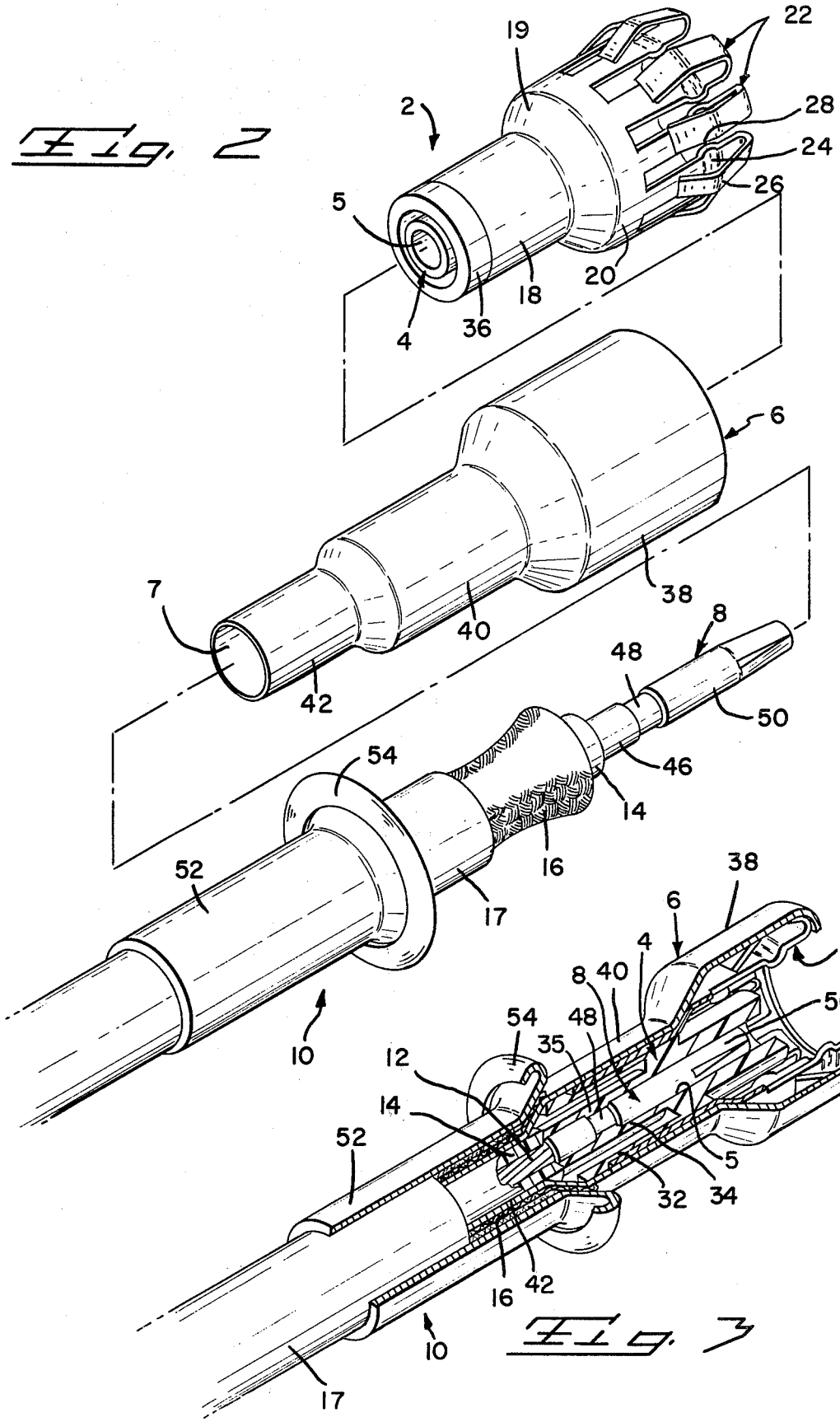
FIG. 2 is a partially assembled view of the subject coaxial connector plug, with the center contact affixed to the center conductor of the cable, and the dielectric body inserted into the spring element.
FIG. 3 is a longitudinal section view through the completed subject coaxial connector plug.

Proceeding to the assembly of the subject coaxial connector plug as illustrated in FIGS. 1 and 2, the coaxial cable is extended through the crimping ferrule 10, and dressed for termination. So prepared, the center conductor 12 projects forwardmost, followed by the dielectric layer 14, and an exposed forward length of the outer conductive shield 16. Thereafter, the center contact 8 is affixed to the center conductor 12, which is inserted into the crimping barrel 46 of contact 8, and subsequently crimped in a conventional manner.

Proceeding, the dielectric body 4 is inserted into the axial bore 3 of the tubular spring element 2, and there positioned serves to electrically isolate the spring element from center contact 8 when inserted into bore 5. The spring element 2 is then press inserted into the axial bore 7 of the shell body 6 from a forward end thereof. Thus assembled, as shown best in FIG. 4, the internal shoulder 19 of the spring element 2 abuts against the internal shoulder 44 of the shell body 6, and the outer leaf 26 of each spring finger 22 contacts the forward hood 38 of the shell body. It will be appreciated from FIG. 4 that the forward end 66 of the hood portion 38 is thereafter rolled over to capture spring element 2 within the shell body 6, as well as to provide protective and lead-in functions as explained below.

Collectively viewing FIGS. 2 and 4, the center contact 8 is inserted into the dielectric body bore 5, and is retained therein as the annular detent 35 snaps over the annular retention groove 48 of the contact. It will be appreciated that the insertion of the contact 8 into the dielectric body 4, causes an outward deflection of the inner cylindrical portion 34, which is facilitated by the spacing 33 between the inner cylinder 34 and the outer cylinder 32. Pursuant to this configuration, the inner cylinder 34 serves as a resilient spring and provides the requisite resilient retention forces for retaining the center contact within the dielectric body. The air gap 33 simultaneously provides a means for achieving impedance matching in the plug.

Referring now to FIG. 3, the rearward portion 42 of the shell body 6 is inserted beneath the outer conductive shield 16 of the coaxial cable, and the crimping ferrule 10 is transported forwardly to entrap the exposed portion of the conductive shield against portion 42 of the shell body. The crimping ferrule 52 is radially crimped in a conventional manner. The annular flange 54 of the crimp ferrule 10 has been rolled over as indicated in FIG. 3 during manufacture to eliminate the exposure of sharp edges.

Proceeding to FIG. 4, it should be noted that in the normal condition, the outer leaf 26 of each spring finger 22 contacts the hood 38 of the shell body, but is not compressed thereby. As the mating jack 56 is inserted between the spring fingers 24, the outer conductive body 60 of the jack influences the spring fingers radially outward and against hood portion 38. Further insertion of the jack into the plug, terminates when the transverse detent ridges 28 of the spring fingers snap into the annular retention recess 64 of the plug body 60. Simultaneously, the center pin 58 penetrates and engages with the female receptacle 50 to electrically interconnect with the center conductor of the coaxial cable.

In the mated condition, the spring leaves 24 and 26 are under a compressive tension and serve to ensure good mechanical and electrical contact between the spring element 2 and the jack body 60. This constitutes an electrical path between the outer conductive shield 16 of the coaxial cable and the outer conductive body 60 of the jack.

The leaf springs 24, 26, simultaneously acting together through detent ridge 28, provide the requisite inwardly directed forces to ensure good electrical contact between the jack shell 60 and the detents 28 disposed in recess 64. Also simultaneously, the leaf springs 24, 26, acting together provide the necessary forces for achieving mechanical retention of the jack body within the plug, not readily achievable by conventionally available single spring contacts. It will be noted that leaf spring 24 functions as a cantilever spring, and that spring 26 operates cumulatively with spring 24 to provide additional radial spring action. Further the profile of spring 26 is such that contact with the hood portion 38 is at a point counter to the detent ridge 28 of spring 26. This serves to concentrate the spring force through detent ridge 28 for improved results.

Figure 5:
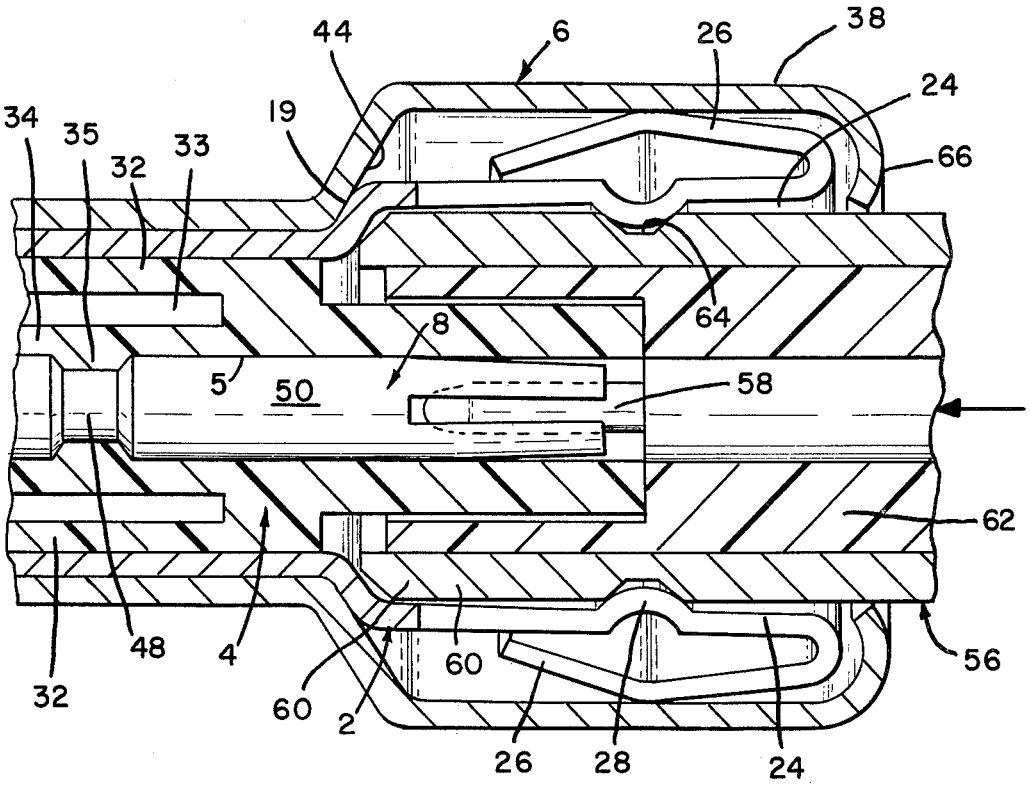
FIG. 5 is a partial longitudinal section through forward portions of the mated plug and jack, illustrating operation of the shell body in protecting the spring element fingers.
Figure 6:
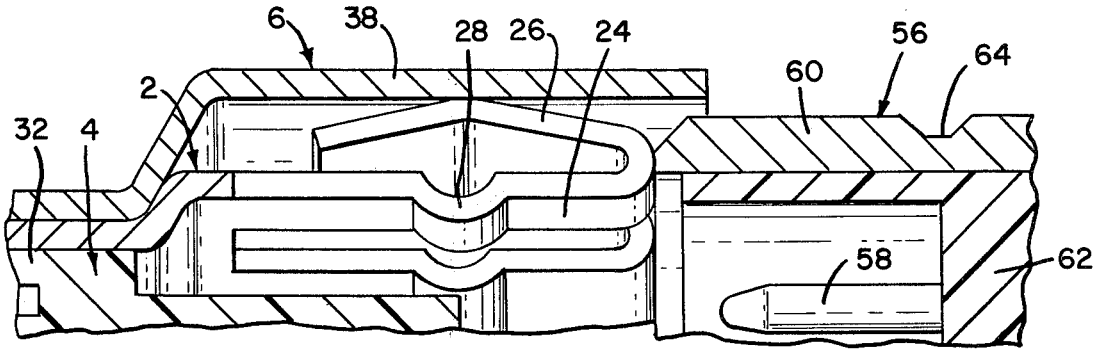
FIG. 6 is a partial section through forward portions of a jack and a plug, not configured pursuant the present invention for the purpose of contrast and explanation.

Referring to FIG. 5, the subject plug is shown mated to the jack 56. The detent ridge 28 of the spring fingers 22, after riding over the forward end of the outer jack body 60, resiliently locks into the jack retention recess 64. Fully inserted, the forward end of the jack body 60 is generally situated adjacent the inner end of the forward plug hood 38. The purpose of the rolled portions 66 of the hood 38 is illustrated by FIGS. 5 and 6. First, the rolled portions provide a lead in for centering the jack body 60 between the inner spring finger leaves 24. Without such a configuration, as shown in FIG. 6, the jack can axially misalign with the plug during mating, and stub against ends of the spring fingers 22, resulting in deformation of the fingers. Secondly, as will be apparent from FIG. 5, the rolled forward edge 66 of the plug hood 38 protect the spring fingers 22 from damage due to lateral manipulations of the plug or jack. The edge 66 limit the degree to which the plug can be laterally manipulated during or after mating with the jack, by stopping against the outer jack body 60. Otherwise, careless lateral manipulation of the plug during withdrawal from the jack could debilitatively damage the spring fingers 22. Thus, the presence of rolled edge 66 serves to protect the spring fingers 22 from damaging engagement with the jack.

It is to be understood that the above described preferred embodiment of the present invention is merely illustrative. Other embodiments, which will become apparent to one skilled in the art, and which utilize the teachings herein set forth, are intended to be within the scope and spirit of the subject invention.

What is claimed is:

1. Improved retention means for a connector tubular plug shell which matingly receives a tubular jack body in a forward end, the improvement comprising:

a tubular spring element seated within a forward end of said tubular plug shell, said spring element comprising forward projecting inner leaf springs defining a passageway therebetween for receiving said jack body with interference, and reversely formed outer leaf springs having forward ends integrally joined to respective forward ends of said inner leaf springs, said inner and outer leaf springs being normally spaced apart, whereby upon insertion of said jack body into said passageway between said inner leaf springs, said inner and outer leaf springs compress against an interior wall of said tubular plug shell to exert radial retention forces on said jack body.

2. Improved retention means as set forth in claim 1, wherein said spring element further comprises a solid cylindrical portion, said inner leaf springs comprising integral extensions of said solid portion.

3. A connector as set forth in claim 1, wherein said cylindrical plug shell having a forward end inwardly formed to protect said integrally joined forward ends of said leaf springs.

4. Improved retention means as set forth in claim 1, wherein each of said inner leaf springs has inwardly directed, transversely extending ridge means located intermediate the ends thereof, said ridge means being adapted to project into complementary recess means in said jack body upon mating engagement between said plug and jack.

5. Improved retention means as set forth in claim 4, wherein each said outer leaf springs has a substantially inverted V-shaped profile, with an apex of said V-shape being longitudinally located to coincide with said ridge means respectively of said inner leaf springs, and said apex comprising an engagement point between said outer leaf springs and an interior wall of said plug shell.

6. Improved retention means for a connector tubular plug shell which matingly receives a tubular jack body in a forward end, the improvement comprising:

tubular spring element seated within a forward end of said tubular plug shell, said spring element comprising a solid cylindrical portion having forward projecting cantilever inner leaf springs defining a passageway therebetween for receiving said jack body with interference, each of said inner leaf springs having inwardly directed, transversely extending ridge means located intermediate the ends thereof, said ridge means being adapted to project into complementary recess means in said jack body upon mating engagement between said plug and jack;

said spring element further comprising reversely formed outer leaf springs having forward ends integrally joined respectively to forward ends of said inner leaf springs, said inner and outer leaf springs being substantially parallel and spaced apart, and each of said outer leaf springs having a substantially inverted V-shaped profile, with apex means of said V-shaped profile being longitudinally located to coincide with said ridge means respectively of said inner leaf springs, whereby upon insertion of said jack body into said passageway between said inner leaf springs, said inner and outer leaf springs compress, as apex means of said outer leaf springs engage an interior wall of said tubular plug shell.

7. Improved retention means as set forth in claim 6, wherein said cylindrical plug shell having a forward end inwardly formed to protect said integrally joined forward ends of said leaf springs.

8. A coaxial connector for terminating a coaxial cable comprising:

contact means for terminating the center conductor of said cable;

dielectric means for insulating said contact means;

tubular shell means for terminating the outer conductor of said cable and receiving said dielectric and contact means therein, said shell means comprising a forward cylindrical portion having an interior wall defining an axial passageway therebetween; and a tubular spring element seated within said cylindrical shell means portion and having a plurality of forward projecting spring finger means defining a passageway therebetween for receiving a tubular jack body with interference;

each of said spring finger means comprising an inner leaf spring means and a free extending reversely formed outer leaf spring means, forward ends of said inner leaf spring means and said outer leaf spring means integrally joined, said spring finger means being normally spaced apart and parallel whereby, upon insertion of said tubular jack body between said inner leaf spring means, said leaf spring means compress against said interior wall of said cylindrical shell portion to exert radial retention forces on said jack body.

9. A connector as set forth in claim 8, wherein said tubular spring element further comprises a solid cylindrical portion, said inner leaf spring means comprising integral extensions of said solid cylindrical portion.

10. A connector as set forth in claim 8, wherein said forward cylindrical shell portion has a forward end inwardly formed forward of said integrally joined forward ends of said leaf spring means.

11. A connector as set forth in claim 8, wherein each of said inner leaf spring means has inwardly directed, transversely extending, ridge means located intermediate the ends thereof.

12. A connector as set forth in claim 11, wherein each said outer leaf spring means has a generally inverted V-shaped profile, with an apex of said inverted V-shape being longitudinally located to coincide with said ridge means of said inner leaf spring means, and said apex engaging said interior wall of said cylindrical shell portion.

13. A coaxial connector for matable engagement with a tubular jack member, comprising:

tubular shell means having tubular element means seated therein;

leaf spring means extending outwardly from said tubular element means along said tubular shell means substantially parallel to an axis of the coaxial connector and defining a lead-in and receiving area into which a forward end of the tubular jack member is to be received; and V-shaped leaf spring means respectively connected to said leaf spring means for applying radial spring action to said leaf spring means as the forward end of the tubular jack member is received in said receiving area thereby urging said leaf spring means into electrical and mechanical connection with the forward end of the tubular jack member.

14. A coaxial connector as set forth in claim 13 wherein a forward end of said tubular shell means is rolled in covering forward ends of said leaf spring means to protect them and defining part of the lead-in for the forward end of the tubular jack member.

15. A coaxial connector as set forth in claim 13 wherein said leaf spring means include detent ridge means for engagement with an annular recess in the forward end of the tubular jack member.

16. A coaxial connector as set forth in claim 15 wherein an apex of said V-shaped leaf spring means engages said tubular shell means in alignment with said detent ridge means.

* * * * *